US007555856B2

(12) United States Patent
Sunshine et al.

(10) Patent No.: US 7,555,856 B2
(45) Date of Patent: Jul. 7, 2009

(54) IRONING STATION

(75) Inventors: Richard A. Sunshine, Granger, IN (US); James William Kendall, Stevensville, MI (US); Lorraine L. Achterberg, Saint Joseph, MI (US); Vicki Lyn Wyatt, Watervliet, MI (US); Ameresh Babu Viswanathan, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 179 days.

(21) Appl. No.: 11/323,270

(22) Filed: Dec. 30, 2005

(65) Prior Publication Data

US 2007/0151130 A1 Jul. 5, 2007

(51) Int. Cl.
*D06F 81/06* (2006.01)
*D06F 81/00* (2006.01)

(52) U.S. Cl. ..... 38/104; 38/107; 38/112; 38/139

(58) Field of Classification Search ..... 38/103, 38/104, 107, 112, 137, 138, 139; 312/290, 312/28, 242
See application file for complete search history.

(56) References Cited

U.S. PATENT DOCUMENTS 496,655 A 5/1893 Hilton
699,922 A * 5/1902 Hyson et al. ..... 38/104
870,805 A * 11/1907 Trager ..... 312/290
900,347 A 10/1908 Berry
916,849 A 3/1909 Darrow
970,174 A 9/1910 Booton
1,255,399 A * 2/1918 Ferren ..... 38/138
1,278,072 A * 9/1918 Ossry ..... 38/111
1,485,991 A 3/1924 Mulley
1,590,390 A 6/1926 Miller
1,994,044 A 3/1935 Michelet
2,287,646 A * 6/1942 Steele ..... 108/99
2,339,495 A 1/1944 McMann
2,447,480 A 8/1948 Stubbs
2,475,106 A * 7/1949 Mohr et al. ..... 38/137
2,499,455 A 3/1950 Brochu
2,548,437 A 4/1951 Mantagas (Continued)

FOREIGN PATENT DOCUMENTS

EP 1146161 A1 4/2000

(Continued)

OTHER PUBLICATIONS

Better Lifesyle Products; Rolling Mobile Laundry Ironing Center; Jul. 28, 2005; http://www.betterlifestyleproducts.com/mobile-laundry-center.html.

*Primary Examiner*—Ismael Izaguirre
(74) *Attorney, Agent, or Firm*—Clifton Green; Michael D. Lafrenz

(57) ABSTRACT

An ironing station comprises a cabinet defining an interior space, an accessible storage area defined within the interior space of the cabinet, an ironing board stowably mounted in the cabinet for movement between a stowed position and a use position and a docking station provided on the top wall of the cabinet for receiving an iron. The ironing board can be at least partially stored within the interior space in the stowed position.

35 Claims, 11 Drawing Sheets

U.S. PATENT DOCUMENTS

| | | | | |
|---|---|---|---|---|
| 2,650,442 | A | | 9/1953 | Johnson |
| 3,022,589 | A | | 2/1962 | Kleinman |
| 3,245,161 | A | * | 4/1966 | Adiletta et al. ..... 38/104 |
| 3,688,706 | A | | 9/1972 | Merryweather |
| 3,745,676 | A | | 7/1973 | Dikoff |
| 4,637,321 | A | | 1/1987 | Hasler et al. |
| 4,995,681 | A | * | 2/1991 | Parnell ..... 312/242 |
| 5,241,766 | A | | 9/1993 | Walz et al. |
| 5,290,998 | A | | 3/1994 | Couch et al. |
| 5,315,773 | A | | 5/1994 | Iwami et al. |
| 5,452,531 | A | * | 9/1995 | Graville et al. ..... 38/104 |
| 5,778,573 | A | | 7/1998 | Nottingham et al. |
| 5,967,342 | A | | 10/1999 | Steffine |
| 5,974,980 | A | | 11/1999 | Kent |
| 6,000,158 | A | | 12/1999 | Zoellner |
| 6,484,645 | B2 | | 11/2002 | Allen |
| 6,572,208 | B2 | | 6/2003 | Albaizar et al. |
| 6,604,473 | B2 | | 8/2003 | Felsenthal |
| 6,883,257 | B2 | | 4/2005 | Couch et al. |
| 7,100,316 | B2 | * | 9/2006 | Obileye ..... 38/139 |

FOREIGN PATENT DOCUMENTS

| | | | |
|---|---|---|---|
| EP | 1444922 | | 8/2004 |
| EP | 1495697 | | 1/2005 |
| GB | 326511 | | 3/1930 |
| GB | 384352 | | 12/1932 |
| GB | 582959 | | 12/1946 |
| GB | 618803 | | 2/1949 |
| GB | 855965 | | 12/1960 |
| GB | 1355656 | | 6/1974 |
| GB | 1399827 | | 7/1975 |
| GB | 2297982 | | 8/1996 |
| JP | 5277298 | | 10/1993 |
| JP | 6-71100 | * | 3/1994 |
| JP | 6343794 | | 12/1994 |
| JP | 2002126395 | | 5/2002 |
| KR | 200201898 | | 11/2000 |
| KR | 1020040009401 | | 1/2004 |
| WO | 8803579 | | 5/1988 |
| WO | 9317601 | | 9/1993 |
| WO | 2004063452 | | 7/2004 |
| WO | 2005045121 | | 5/2005 |

* cited by examiner

IRONING STATION

BACKGROUND OF THE INVENTION

1. Field of the Invention

The present invention relates to an ironing station.

2. Description of the Related Art

Laundry appliances, such as washing machines and clothes dryers, for cleaning fabric items are commonly housed in one area of a home, such as a dedicated laundry room. Basic laundry care and cleaning of fabric items requires washing and drying fabric items. Additional laundry care can require other steps, including ironing to remove or reduce wrinkles in fabric items.

Ironing is often done away from the laundry room, since many laundry rooms have space restrictions that prohibit the user from setting up an ironing board and ironing fabric items within the laundry room. Most irons must be plugged into an electrical outlet for power, thus further limiting the area in which ironing can be accomplished. Some cordless irons are available to consumers, but these irons require a recharging stand that must be set up and plugged into an electrical outlet.

Laundry aids and equipment used during ironing are stored when not in use, and it is advantageous to the user to store these items near the location where they are used. Some users use separate storage means, such as shelving systems, cabinets, or cupboards, that are added to a laundry room to the often limited area not already utilized by the washing machine or clothes dryer. These separate storage means can lend a haphazard appearance the laundry room, especially when compared to a matched-set washing machine and clothes dryer.

Ironing requires additional equipment, including an iron and ironing board and can require one or more laundry aids. A laundry aid is a substance or agent used to clean or care for fabric items, such as, but not limited to, a laundry detergent, fabric softener, dryer sheets, bleach, spray-dewrinkler, starch, or other substance used for cleaning or caring for fabric items.

SUMMARY OF THE INVENTION

According to one aspect of the invention, an ironing station comprises a cabinet having spaced side walls connected by a top wall to at least partially define an interior space accessible through an open face of the cabinet, a storage area defined within the interior space of the cabinet and accessible through the open face, an ironing board stowably mounted to the cabinet for selective movement between a stowed and a use position, and a docking station provided on the top wall of the cabinet for receiving an iron.

The docking station can comprise a power supply to provide power to the iron. The power supply can automatically supply power to the iron when the iron is received by the docking station. The iron can be a cordless iron. The docking station can support the iron on the top wall of the cabinet. The docking station can be formed in the top wall of the cabinet.

The ironing board can be received within the interior space of the cabinet in the stowed position. The ironing board can be slidably mounted to the cabinet. A support carrying the ironing board can be slidably mounted to the cabinet. The ironing board can be mounted to the support for movement in an least one of a linear and rotational movement. The ironing board can be mounted to the support for both linear and rotational movement. A front panel can be pivotally mounted to the support for movement between an up position for hiding the ironing board when the ironing board is in the stowed position and a down position for moving the ironing board relative to the support.

A portion of the ironing board can be pivotally mounted to the cabinet to enable movement between the stowed and use positions. The portion of the ironing board can form a generally continuous surface with the top wall of the cabinet when in the stowed position. The ironing board can be formed by a leaf pivotally mounted to the cabinet and a portion of the top wall of the cabinet. The leaf can overlie the portion of the top wall when the ironing board is in the stowed position. A support can be mounted to the cabinet for supporting the leaf when the ironing board is in the stowed position.

The storage area can comprise a drawer or multiple drawers slidably mounted to the cabinet for movement through the open face. The storage area can comprise a door that selectively closes a portion of the open face of the cabinet. The storage area can comprise both a drawer slidably mounted to the cabinet for movement through the open face and a door that selectively closes a portion of the open face of the cabinet.

According to another aspect of the invention, an ironing station comprises a cabinet having spaced side walls connected by a top wall to at least partially define an interior space accessible through an open face of the cabinet, a storage area defined within the interior space of the cabinet and accessible through the open face, an ironing board stowably mounted to the cabinet for selective movement between a stowed position where the ironing board is at least partially stored within the interior space and a use position, and a docking station mounted to the cabinet for receiving an iron.

The docking station can comprise a power supply to provide power to the iron. The power supply can automatically supply power to the iron when the iron is received by the docking station. The iron can be a cordless iron. The docking station can support the iron on the top wall of the cabinet. The docking station can be formed in the top wall of the cabinet.

The ironing board can be slidably mounted to the cabinet. A support carrying the ironing board can be slidably mounted to the cabinet. The ironing board can be mounted to the support for movement in an least one of a linear and rotational movement. The ironing board can be mounted to the support for both linear and rotational movement. A front panel can be pivotally mounted to the support for movement between an up position for hiding the ironing board when the ironing board is in the stowed position and a down position for moving the ironing board relative to the support.

The storage area can comprise a drawer or multiple drawers slidably mounted to the cabinet for movement through the open face. The storage area can comprise a door that selectively closes a portion of the open face of the cabinet. The storage area can comprise both a drawer slidably mounted to the cabinet for movement through the open face and a door that selectively closes a portion of the open face of the cabinet.

DESCRIPTION OF EMBODIMENTS OF THE INVENTION

Figure 1:
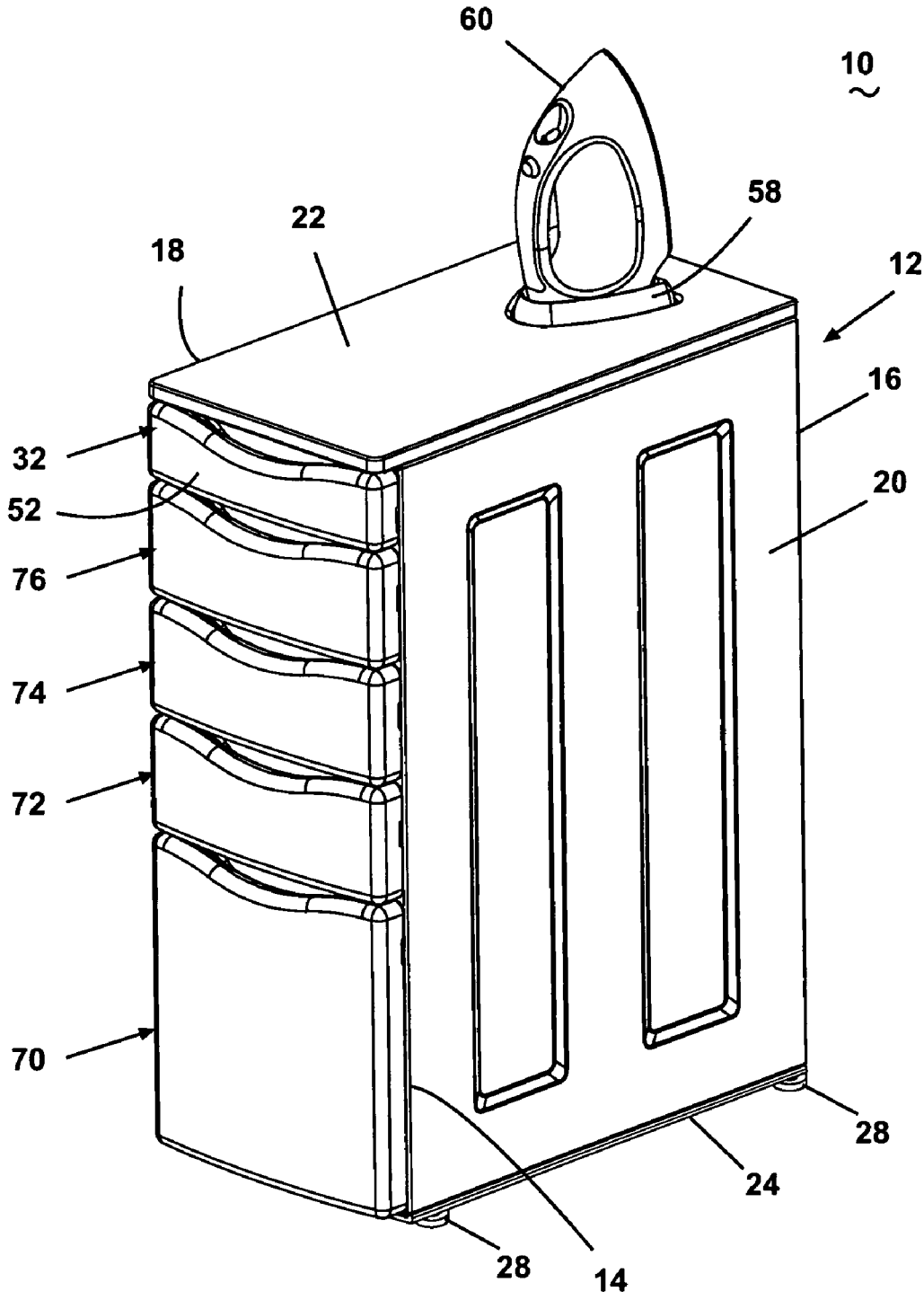
FIG. 1 is a perspective view of a portable ironing station according to a first embodiment of the invention, with an ironing board in a stowed position.

Referring to the drawings, FIG. 1 illustrates an ironing station 10 according to one embodiment of the invention. The ironing station 10 comprises a cabinet 12 having spaced front and rear walls 14, 16 joined by spaced left and right side walls 18, 20 and enclosed by spaced top and bottom walls 22, 24. The cabinet 12 defines an interior space of the ironing station 10, and can have an opening in one of the walls to provide access to the interior space, as will be described below. The ironing station 10 can have a roughly rectangular box shape with a height, width, and depth defining the spatial dimensions of the ironing station 10. By way of example, and without limitation, the dimensions of the ironing station 10 can be about 35"H×13.5"W×25.75"D. The ironing station 10 can further comprise supports 28 that are connected to the bottom wall 24. The supports 28 are illustrated as posts on which the ironing station 10 stands, however, the supports 28 can also comprise wheels so that the ironing station 10 is portable and can easily be moved, for example, to clean underneath or behind the ironing station 10 or to move the ironing station 10 to a different location.

Figure 2:
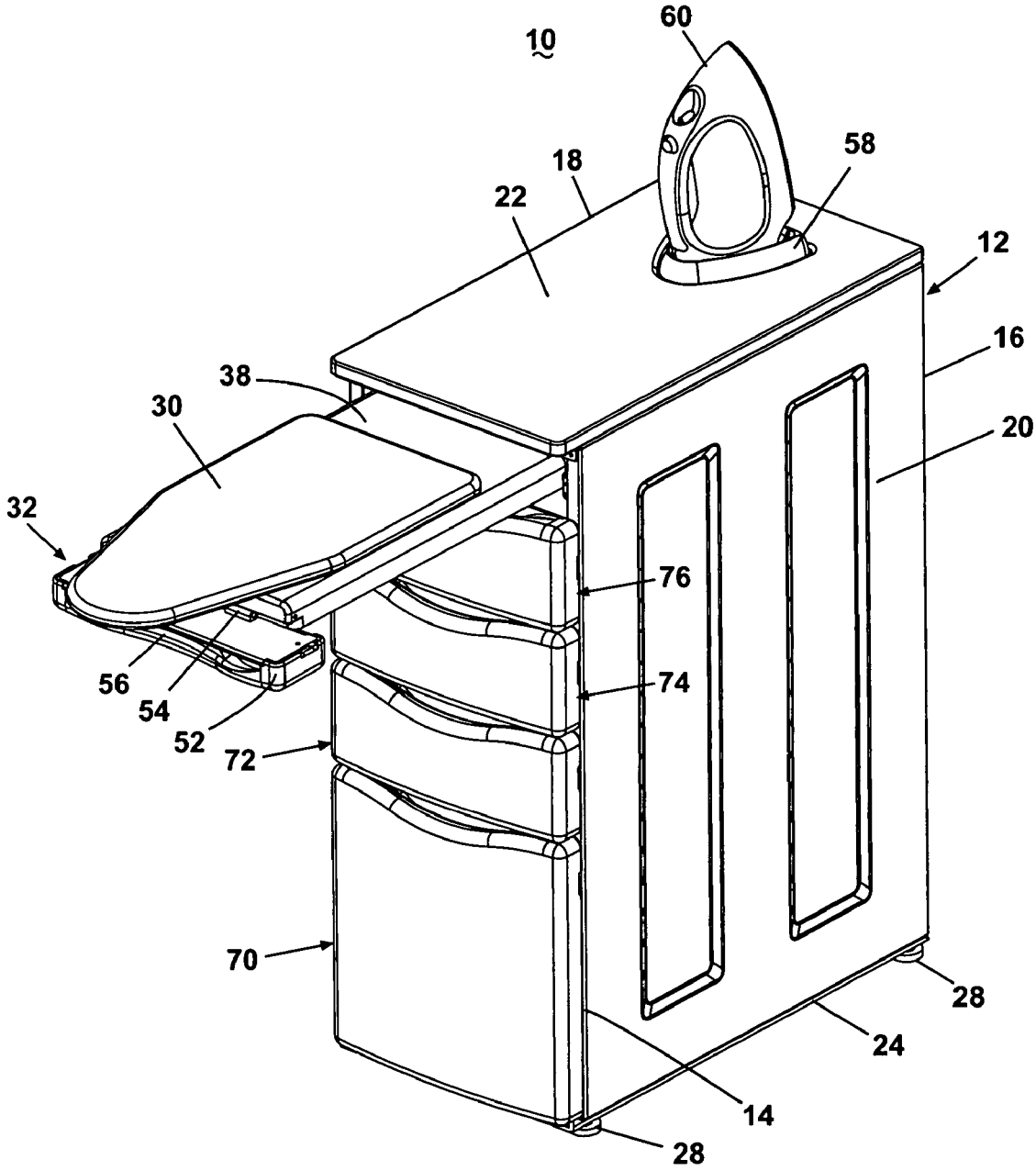
FIG. 2 is a perspective view of the ironing station from FIG. 1, with the ironing board in a use position.

Referring to FIG. 2, the ironing station 10 is provided with an ironing board 30 that is stowably mounted to the cabinet 12. The ironing board 30 can have a typical shape, with a tapered end and a blunt end. The ironing board 30 is selectively movable between a stowed position where the ironing board 30 is received within the interior space of the cabinet 12 (FIG. 1) and a use position where the ironing board 30 can be utilized for ironing purposes (FIG. 2). In the use position, the ironing board 30 can also be used as a shelf, such as for resting a laundry basket or other items. The ironing board 30 can be slidably mounted to the cabinet 12 for movement between the stowed and use positions. For example, the ironing board 30 can be carried by a support 32 that is slidably mounted to the cabinet 12, such that the support 32 slides through the front wall 14. The support 32 can be mounted in the cabinet 12 using any suitable mounting means such that the support 32 can slidably move relative to the cabinet 12. For example, a pair of runners (not shown) can be attached to the support 32 that interact with corresponding tracks attached to the inside surface of the left and right side walls 18, 20 of the cabinet 12.

Figure 3:
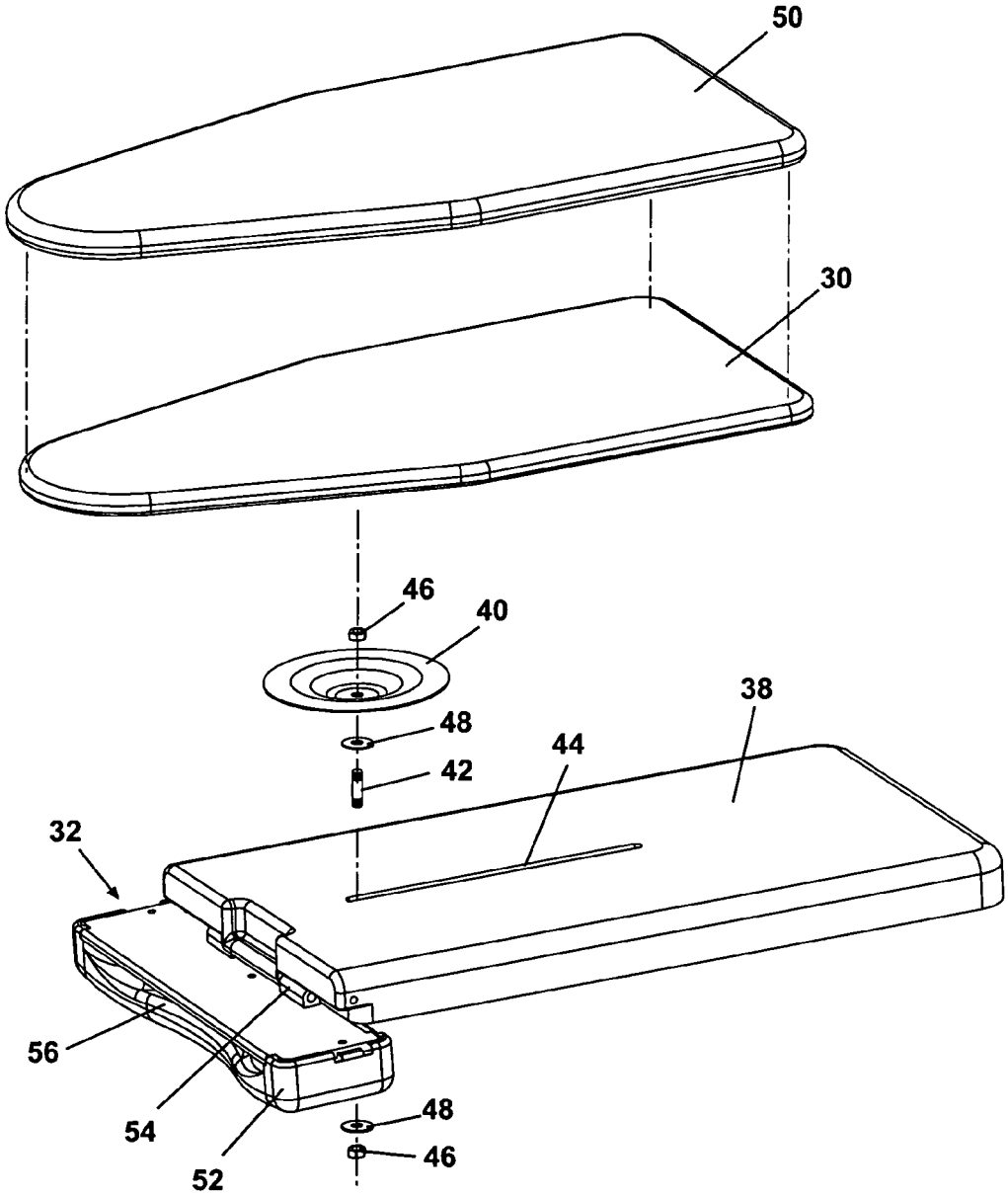
FIG. 3 is an exploded view of the ironing board and an ironing board support of the ironing station from FIG. 2.

Referring to FIG. 3, the support 32 comprises a platform 38 that movably supports the ironing board 30 for both linear and rotational movement. A rotating bracket 40 is attached to a bolt 42 that is slidable within a track 44 formed on the platform 38 such that as the bolt 42 slides linearly within the track 44, and the bracket 40 and the ironing board 30 slide likewise. The bolt 42 is threaded at both ends to receive a pair of nuts 46 and washers 48 that secures the bolt 42 and bracket 40 to the platform 38. The bracket 40 can be attached to the bottom surface of the ironing board 30 such that the ironing board 30 can be rotated relative to the support 32 through a number of positions encompassing a 360° range of movement, including a first exemplary position (shown in solid line in FIG. 4), where the pointed end of the ironing board 30 is toward the rear of the cabinet 12, a second exemplary position (shown in dash-dot-dash-dot line in FIG. 4), where the pointed end of the ironing board 30 is 90° from the first exemplary position, and a third exemplary position (shown in dotted line in FIG. 4), where the pointed end of the ironing board 30 is 180° from the first exemplary position. In the stowed position, the ironing board is typically positioned with the tapered end pointed toward the rear wall and the bolt 42 slid rearwardly in the track 44, such as shown by the first exemplary position. In the use position, the ironing board 30 is typically positioned with the bolt 42 slid forwardly in the track 44, however, the ironing board 30 can be rotated to any orientation so that the user can selectively use both the tapered end and the blunt end for different ironing needs, such as shown by the second and third exemplary positions. While the ironing board 30 is shown mounted to the platform 38 for both linear and rotational movement, it is within the scope of the invention for the ironing board 30 to be mounted to the platform 38 for only linear movement or for only rotation movement. A removable cover 50 can be placed over the ironing board 30, such as a washable elastic cover.

The support 32 further comprises a front panel 52 that is pivotally mounted to the forward end of the platform 38 and is pivotable between an up position, where the front panel 52 is generally perpendicular to the platform 38, as shown in FIG. 1, for hiding the ironing board 30 when the ironing board 30 is in the stowed position within the cabinet 12 and a down position, where the front panel 52 is generally parallel to the platform 38, as shown in FIGS. 2 and 3, for moving the ironing board 30 relative to the support. As best seen in FIG. 3, the front panel 52 can be pivotally mounted to the platform 38 by a hinge 54. The front panel 52 can further comprises a handle 56 integrally formed along the upper edge of the front panel 52 that allows the user to grip the handle 56 to slide the support 32 relative to the cabinet 12 and to pivot the front panel 52 relative to the platform 38.

An exemplary description of the operation of the ironing board 30 follows. It will be apparent to one of ordinary skill that the operation procedure can proceed in any logical order and is not limited to the sequence presented below. The following description is for illustrative purposes only and is not intended to limit the invention in any manner.

Figure 4:
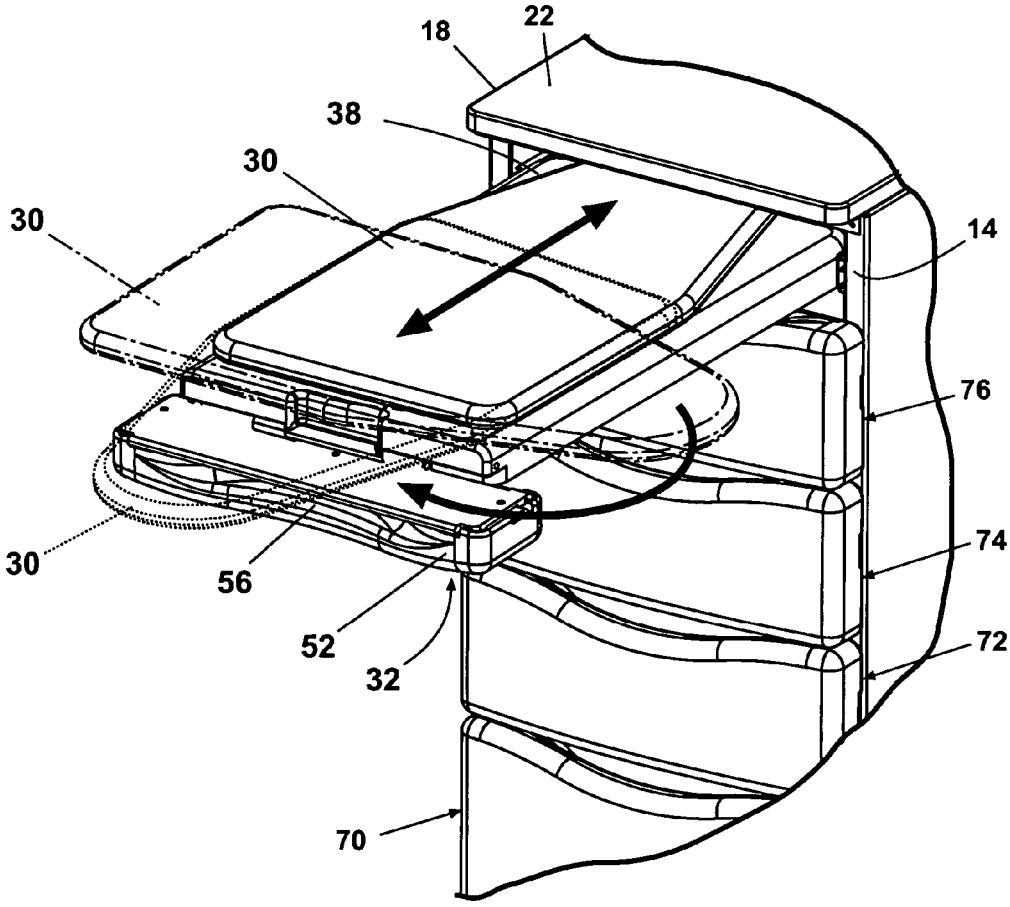
FIG. 4 is a perspective view of the ironing station from FIG. 1, illustrating the operation of the ironing board.

Referring to FIG. 4, to move the ironing board 30 from the stowed position to the use position, the support 32 is extended outward from the cabinet 12, and the front panel 52 is pivoted forwardly to the down position. The ironing board 30 is slid forward along the track 44 to allow the ironing board 30 to extend forwardly of the support 32. The ironing board 30 is then rotated to any desired angle with respect to the support 32. Two exemplary positions, 90° and 180° from the original orientation are illustrated, although the use position can comprise any orientation of the ironing board 30 in which the user can utilize the ironing board for ironing purposes.

Figure 5:
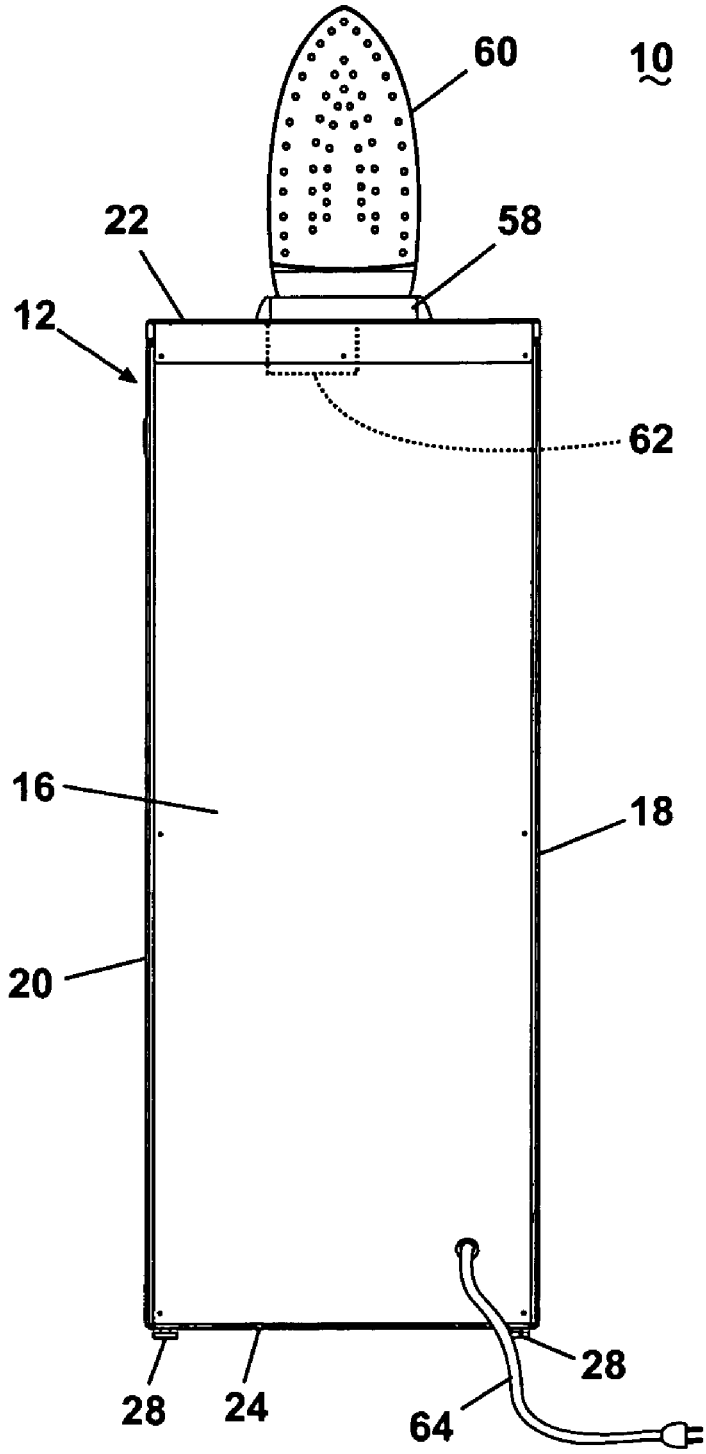
FIG. 5 is a rear review of the ironing station from FIG. 1.

Referring to FIG. 5, a docking station 58 for a receiving an iron 60 is provided on the top wall 22 of the cabinet 12. The docking station 58 comprises a power supply 62 to provide power to an iron 60. The power supply 62 can be mounted to the cabinet 12 or can be separate from the cabinet 12. The docking station 58 can have a power cord 64 that extends exteriorly of the cabinet 12, for example, through the rear wall 16, and supplies the power from a household power source to the power supply 62. The docking station 58 can be integrally formed in the top wall 22 of the cabinet 12 and can be positioned near the rear of the cabinet 12 for safety reasons so that, for example, a user does not inadvertently touch the iron 60 when hot and the iron 60 is kept out of reach for small children. The docking station 58 can support the iron 60 in an upstanding position as shown in FIG. 5, by being formed to complement the base of the iron 60. The iron 60 can be a cordless iron that is recharged by the power supply 62 when received by the docking station 58.

Figure 6:
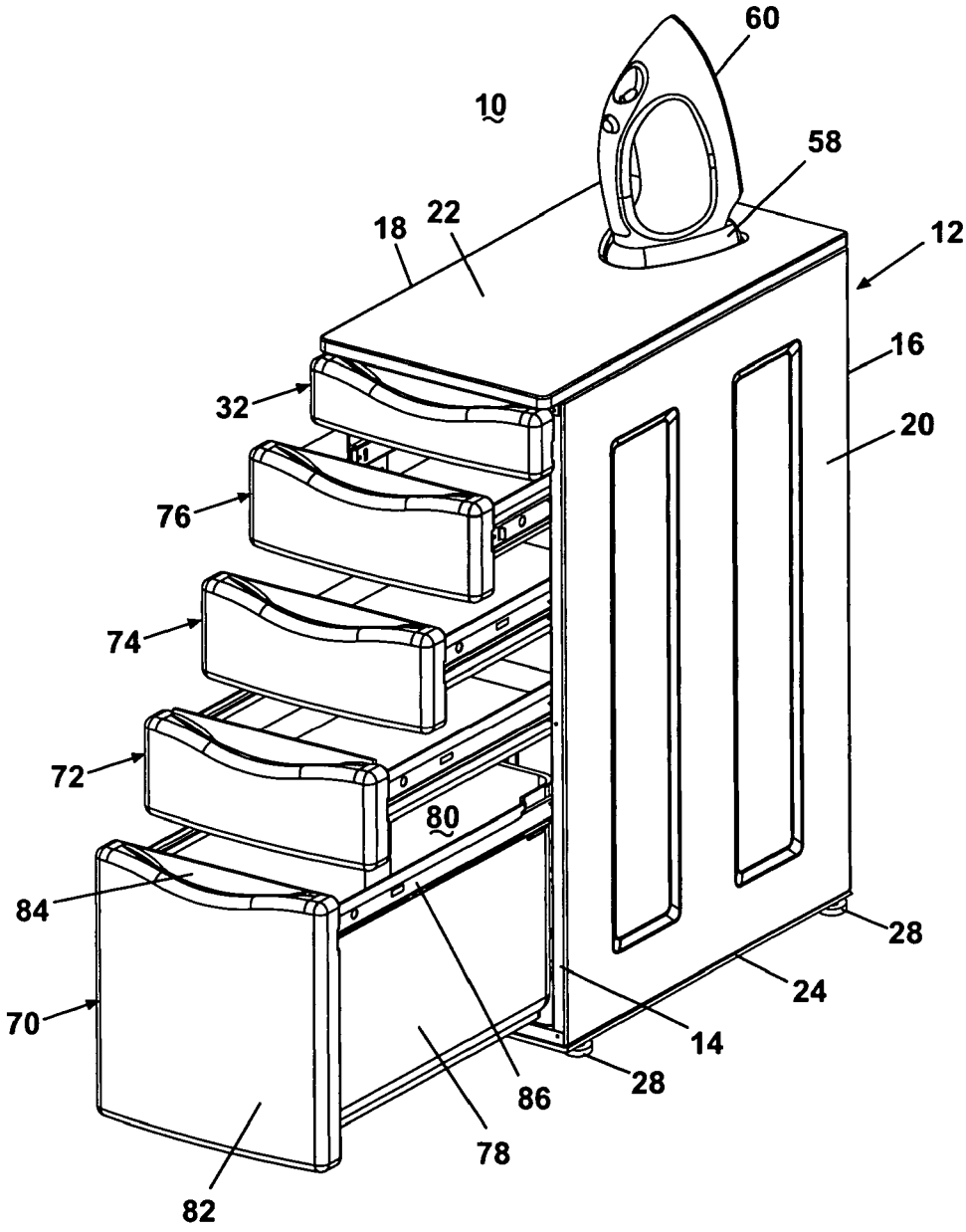
FIG. 6 is a perspective view of the ironing station from FIG. 1, with drawers in an open position.

The ironing station 10 further comprises a storage area defined within the interior space of the cabinet 12 that is accessed through an open face of the cabinet 12, for example, an open face formed in the front wall 14. Referring to FIG. 6, the storage area comprises four drawers 70, 72, 74, 76, that slidably open from the front wall 14 of the cabinet 12. The drawers 70, 72, 74, 76 are positioned in the cabinet 12 below the ironing board support 32.

The drawers 70, 72, 74, 76 will now be described with reference to the lowermost drawer 70, however, the description is applicable to the other drawers 72, 74, 76. The drawer 70 comprises a drawer body 78 defining a storage space 80 with an open top allowing the user to access the storage space 80 when the drawer 70 is extended from the cabinet 12. A front panel 82 is further joined to the front of the drawer body 78 using any suitable fastening means. The front panel 82 has a handle 84 integrally formed along the top edge of the front panel 82 to enable the user to pull the drawer 70 out from the cabinet 12 to access the storage space 80. The drawer 70 can be mounted to slidably open from the front wall 14 of the cabinet 12 using any suitable mounting means. For example, a pair of runners 86 can be attached to the outer surfaces of the drawer body 78 that interact with a corresponding pair of tracks (not shown) attached to the inside surface of the left and right side walls 18, 20 of the cabinet 12.

The width and depth of the drawers 70, 72, 74, 76 are such that the drawers 70, 72, 74, 76 can fit within the cabinet 12. The height of the drawers 70, 72, 74, 76 can vary, thus providing different amount of storage by varying the size of the storage space 80 in each drawer 70, 72, 74, 76 and allowing selective drawers to be easily accessed when the ironing board 30 is in the use position. The lowermost drawer 70 is preferably of a height where, for example, a laundry aid such as a bottle of detergent can stand upright in the drawer 70 without having to lie on a side, and the storage space 80 of the drawer 70 can be easily accessed when then ironing board 30 is in the use position. The preferred height for the lower drawer 70 is about 14.25". The upper three drawers 72, 74, 76 can be of lesser heights than the lower drawer 70. The preferred height for the upper three drawers 72, 74, 76 is about 5.25". While the drawers 72, 74 are easily accessible when the ironing board 30 is in the use position, the topmost drawer 76 is not.

The drawers 70, 72, 74, 76 can be used to provide needed storage for laundry aids and additional equipment. A laundry aid is a substance or agent used to clean or care for fabric items, such as, but not limited to, a laundry detergent, fabric softener, dryer sheets, bleach, spray-dewrinkler, or other substance used for cleaning fabric items. Additional equipment required for laundry care can include items such as hangers and hanging rods for hanging fabric items, and mesh-screens for flat-drying. The drawers 70, 72, 74, 76 can also be used to store the iron 60 when the iron 60 is not in use or received by the docking station 58.

Figure 7:
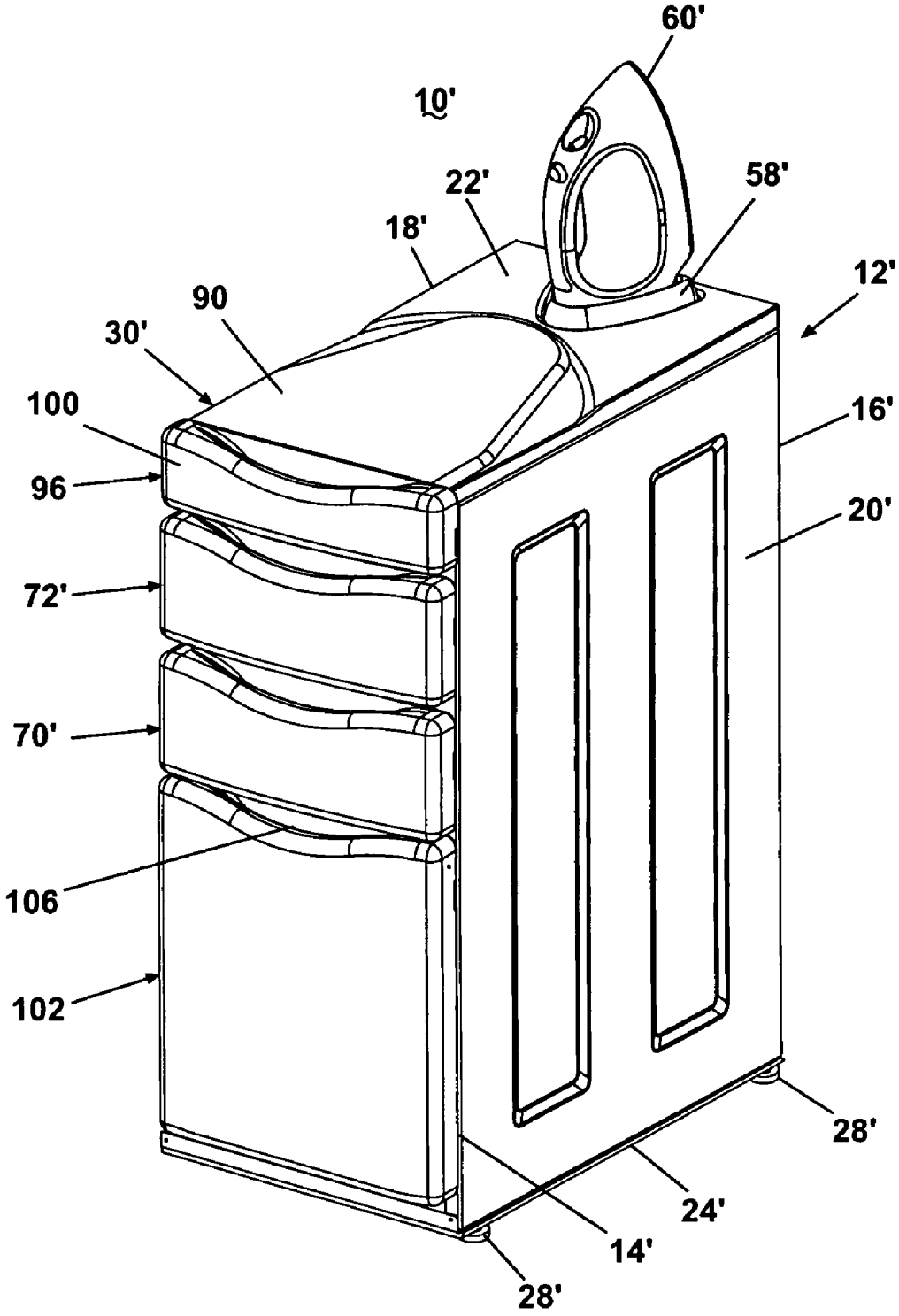
FIG. 7 is a perspective view of a portable ironing station according to a second embodiment of the invention, with an ironing board in a stowed position.
Figure 8:
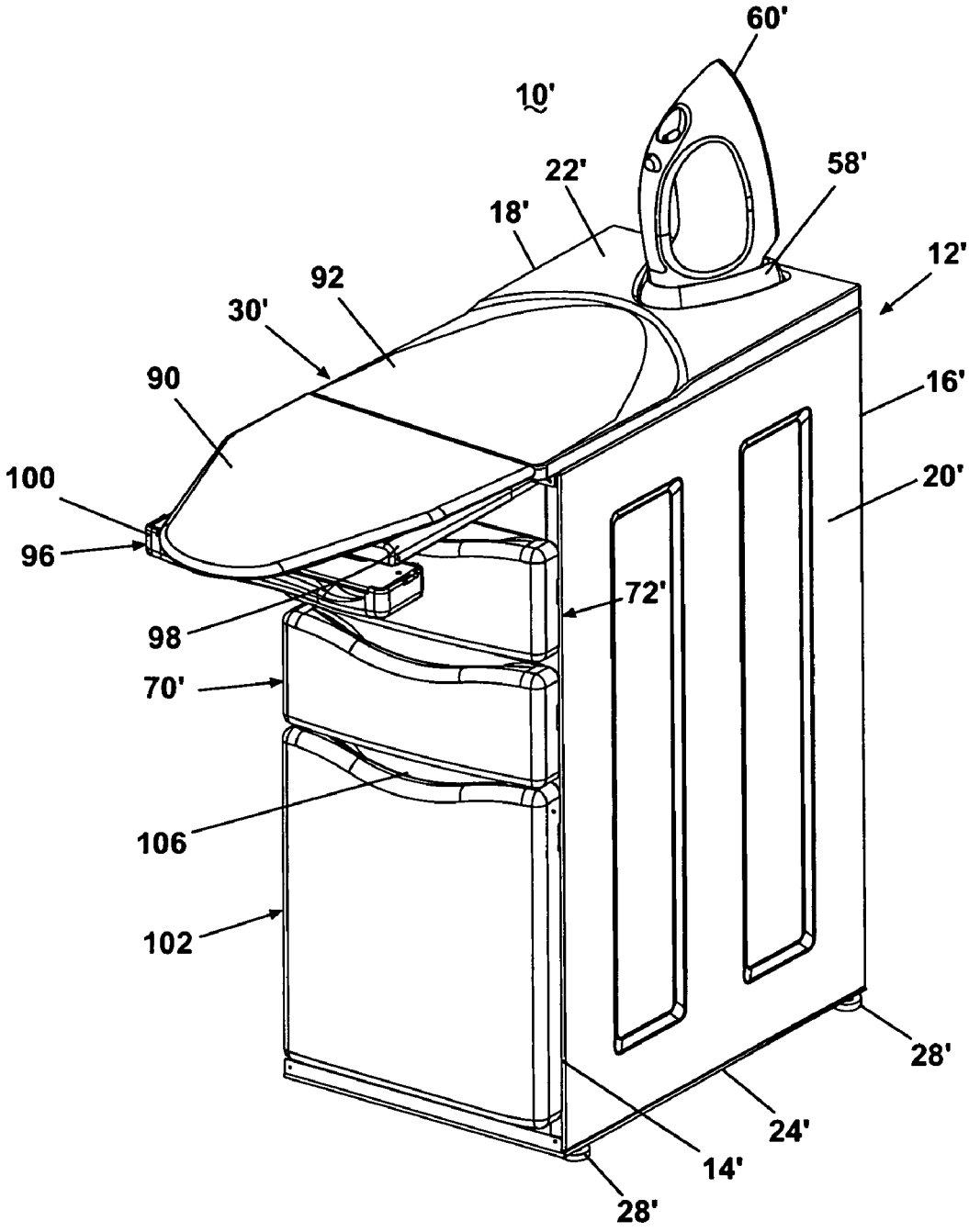
FIG. 8 is a perspective view of the ironing station from FIG.7, with the ironing board in a use position.
Figure 9:
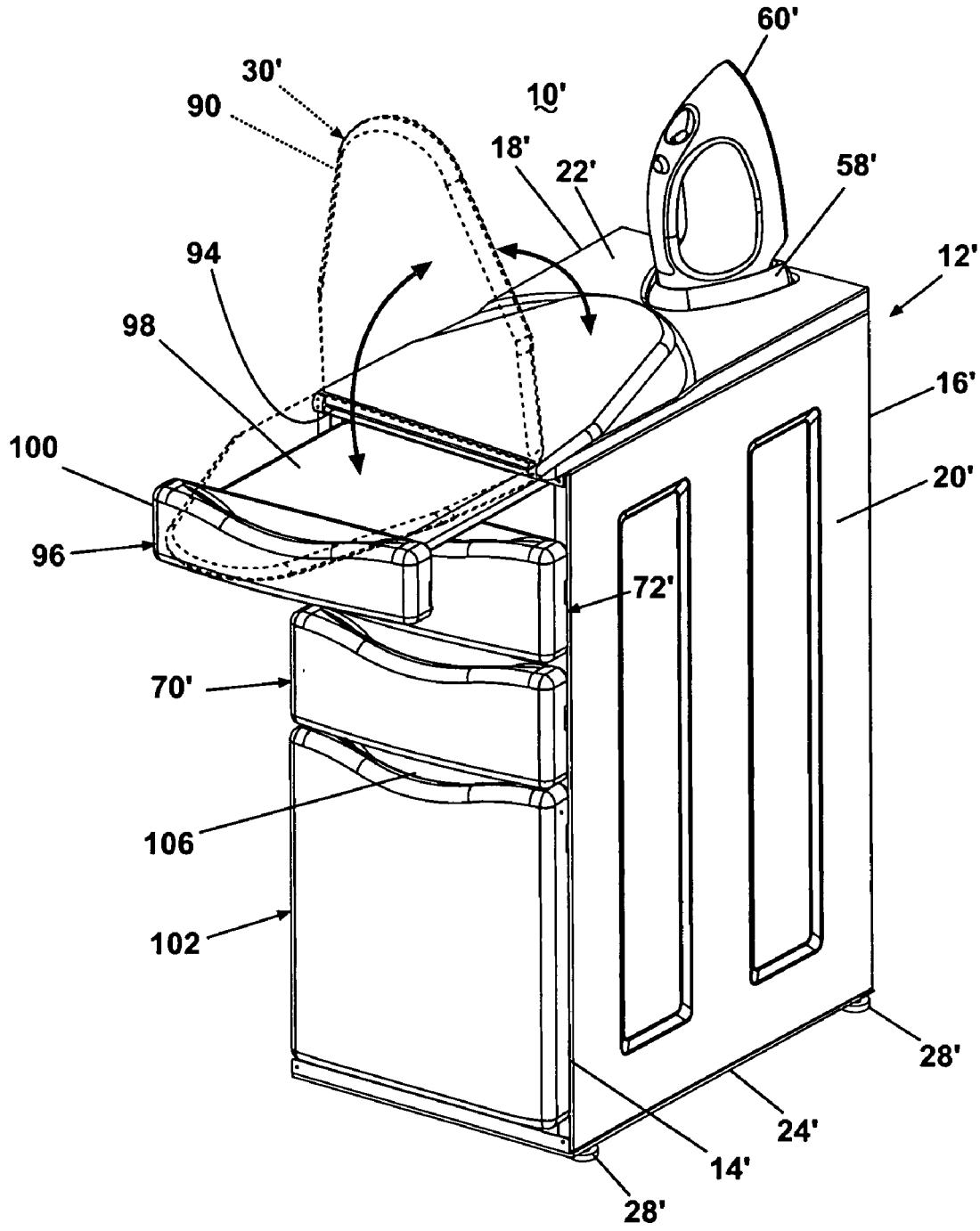
FIG. 9 is a perspective view of the ironing station from FIG. 7, illustrating the operation of the ironing board.

According to a second embodiment of the invention shown in FIG. 7, where elements similar to those of the first embodiment ironing station 10 are identified by the same reference numerals bearing a prime (') symbol, the ironing station 10' can comprise an ironing board 30' that is pivotally mounted to the cabinet 12' for movement between the stowed and use positions. The ironing board 30' can be mounted to the cabinet 12' such that a portion of the ironing board 30' forms a generally continuous surface with the top wall 22' of the cabinet 12' when the ironing board 30' is in the stowed position. The ironing board 30' can comprise a leaf 90 that is pivotable from the stowed position, where the leaf 90 overlies a portion 92 of the top wall 22', to the use position (FIG. 8) where the leaf 90 extends from the cabinet 12 and the ironing board 30' can be utilized for ironing purposes. The portion 92 can form a rear portion of the ironing board 30' such the leaf 90 and rear portion 92 are substantially even when in the ironing board 30' is in the use position to form a continuous surface for ironing. The leaf 90 and rear portion 92 can be joined by a hinge 94 (FIG. 9). The shape of the rear portion 92 of the top wall complements the shape of the leaf 90, and the rear portion 92 is recessed in the top wall 22' a distance substantially equal to the thickness of the leaf 90 such that, when the ironing board 30' is in the stowed position, the leaf 90 is flush with the top wall 22' to form a generally continuous surface.

The ironing station 10' can further comprise a support 96 mounted to the cabinet 12' for supporting the leaf 90 when the ironing board 30' is in the use position. The support 96 can be mounted to slidably open from the front wall 14' of the cabinet 12' using any suitable mounting means. The support 96 can be positioned in the cabinet 12' beneath the ironing board 30' and can comprise a platform 98 on which the leaf 90 rests in the use position. A front panel 100 can be pivotally mounted to the forward end of the platform 98 and is pivotable between an up position, where the front panel 100 is generally perpendicular to the platform 98, as shown in FIGS. 7 and 9, for hiding the hinge 94 when the ironing board 30' is in the stowed position and a down position, where the front panel 100 is generally parallel to the platform 98, as shown in FIG. 8, for supporting the ironing board 30' on the platform 98. The support 96 can span the width of the cabinet 12' as illustrated, or can be of a lesser width.

An exemplary description of the operation of the ironing board 30' follows. It will be apparent to one of ordinary skill that the operation procedure can proceed in any logical order and is not limited to the sequence presented below. The following description is for illustrative purposes only and is not intended to limit the invention in any manner.

Referring to FIG. 8, to move the ironing board 30' from the stowed position to the use position, the support 96 is extended outward from the cabinet 12 and the front panel 96 is pivoted forwardly to the down position (FIG. 8). As shown by arrows and illustrated in phantom, the leaf 90 is pivoted about the hinge 94 to a generally horizontal position where the ironing board 30' extends forwardly of the support 96. Thus the rear portion 92 of the ironing board 30' is uncovered and is available to the user as an ironing surface, in addition to the leaf 90.

Figure 10:
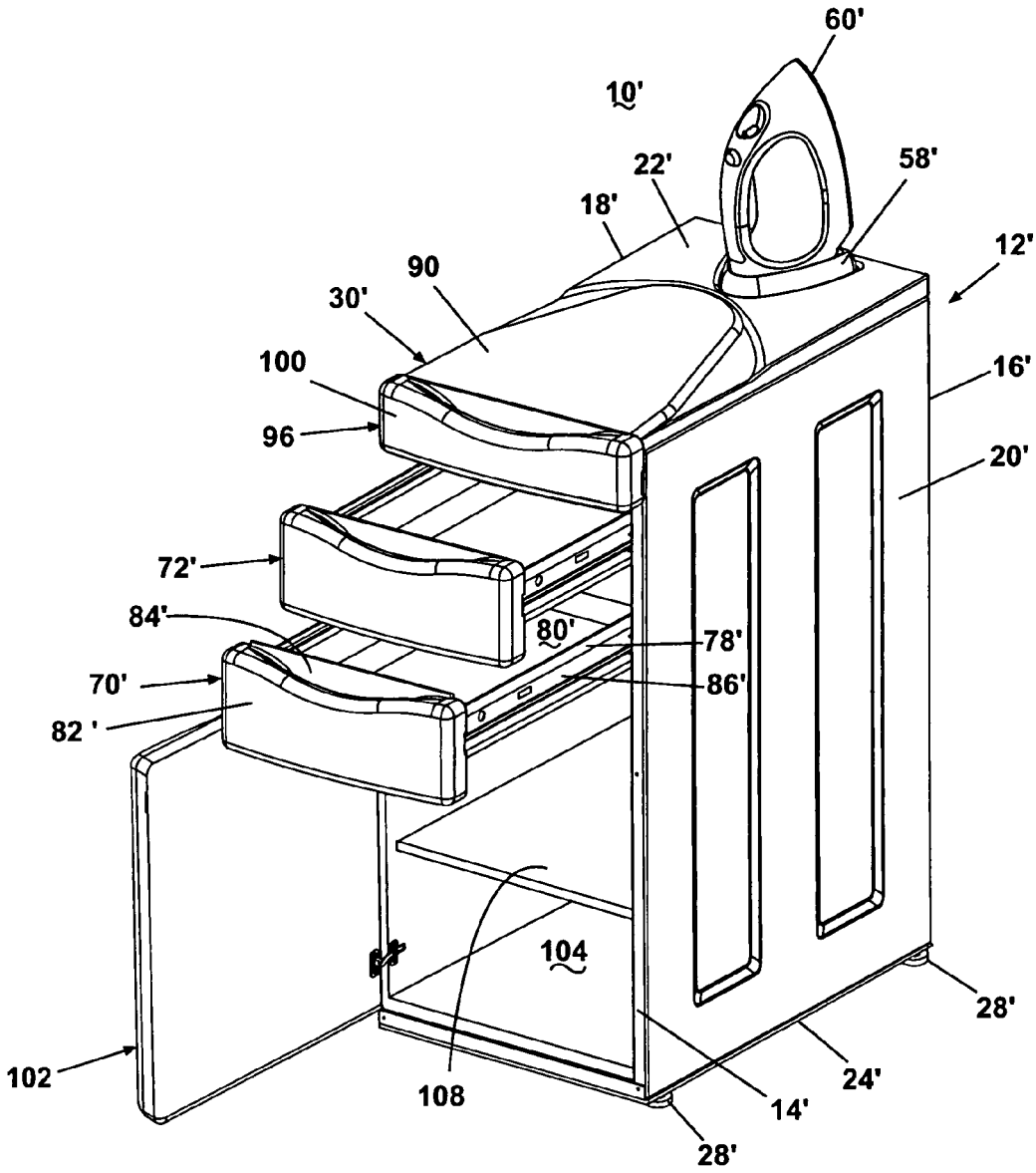
FIG. 10 is a perspective view of the ironing station from FIG.7, with a door and drawers in an open position.

Referring to FIG. 10, the ironing station 10' further comprises a storage area defined within the interior space of the cabinet 12' that is accessed through an open face of the cabinet 12', for example, an open face formed in the front wall 14'. The storage area comprises a door 102 that selectively closes a portion of the open face and two drawers 70', 72' that slidably open from the front wall 14' of the cabinet 12'. The door 102 opens from the front wall 14' of the cabinet 12' to reveal a storage space 104. A handle 106 is formed on the door 102 to enable the user to grip the handle 106 and pull open the door 102. As illustrated, the handle 106 is integrally formed along the top edge of the door 102, but can also be formed along a side edge of the door 102 or as a separate piece attached to the front of the door 102. A shelf 108 is positioned in the storage space 104 and can be adjustable to adjust the vertical position of the shelf 108 or to completely remove the shelf 108.

The height of the door 102 and the drawers 70', 72' can vary, thus providing different amount of storage by varying the size of the respective storage spaces 104, 80'. The door 102 is preferably of a height where, for example, a laundry aid such as a bottle of detergent can stand upright in the storage space 104 without having to lie on a side. The preferred height for the door 102 is about 14.25". The drawers 70', 72' can be of a lesser height than the door 102. The preferred heights for the drawers 70', 72' are about 5.25.

The ironing station 10, 10' of the present invention is particularly suitable as part of a laundry system, as disclosed in application Ser. No. 11/323,125, filed concurrently herewith, and titled "Modular Laundry System with Horizontal Modules," application Ser. No. 11/322,715, filed concurrently herewith, and titled "Modular Laundry System with Horizontal Module Spanning Two Laundry Appliances," application Ser. No. 11/323,221, filed concurrently herewith, and titled "Modular Laundry System with Horizontally Arranged Cabinet Module," application Ser. No. 11/322,739, filed concurrently herewith, and titled "Modular Laundry System with Horizontal and Vertical Modules," application Ser. No. 11/323,075, filed concurrently herewith, and titled "Modular Laundry System with Vertical Module," application Ser. No.11/323,147, filed concurrently herewith, and titled "Modular Laundry System with Cabinet Module," application Ser. No. 11/323,742, filed concurrently herewith, and titled "Laundry Module for Modular Laundry System," application Ser. No. 11/323,220, filed concurrently herewith, and titled "Modular Laundry System with Work Surface," application Ser. No. 11/323,773, filed concurrently herewith, and titled "Modular Laundry System with Segmented Work Surface," application Ser. No. 11/323,741, filed concurrently herewith, and titled "Modular Laundry System with Work Surface Having a Functional Insert," application Ser. No. 11/323,740, filed concurrently herewith, and titled "Modular Laundry System with Work Surface Having a Functional Element," and application Ser. No. 11/323,658, filed concurrently herewith, and titled "Modular Laundry System with Shelf Module," which are incorporated herein by reference in their entirety.

The laundry system can comprise at least one laundry appliance and examples of the laundry appliance include, but are not limited to, a washing machine, including top-loading, front-loading, vertical axis, and horizontal axis washing machines, a dryer, such as a tumble dryer, including top-loading dryers and front-loading dryers, a combination washing machine and dryer, a tumbling refreshing machine, an extractor, and a non-aqueous washing apparatus. An exemplary non-aqueous washing apparatus is disclosed in U.S. Patent Application Publication No. 2005/0155393, which is incorporated herein by reference in its entirety.

The laundry system can also comprise a vertical laundry module and examples of suitable vertical laundry modules are disclosed in application Ser. No. 11/323,867, filed concurrently herewith, and titled "Vertical Laundry Module," application Ser. No. 11/322,943, filed concurrently herewith, and titled "Vertical Laundry Module with Backsplash," and application Ser. No. 11/322,944, filed concurrently herewith, and titled "Sink Station with Cover," which are incorporated herein by reference in their entirety.

The laundry system can also comprise a horizontal laundry module and examples of suitable horizontal laundry modules are disclosed in application Ser. No. 11/322,502, filed concurrently herewith, and titled "Non-Tumble Clothes Dryer," which is incorporated herein by reference in its entirety.

The laundry appliance, vertical laundry module, and/or horizontal laundry module can further comprise a hanging element, such as is disclosed in application Ser. No. 11/322,503, filed concurrently herewith, and titled "Retractable Hanging Element," which is incorporated herein by reference in its entirety.

Figure 11:
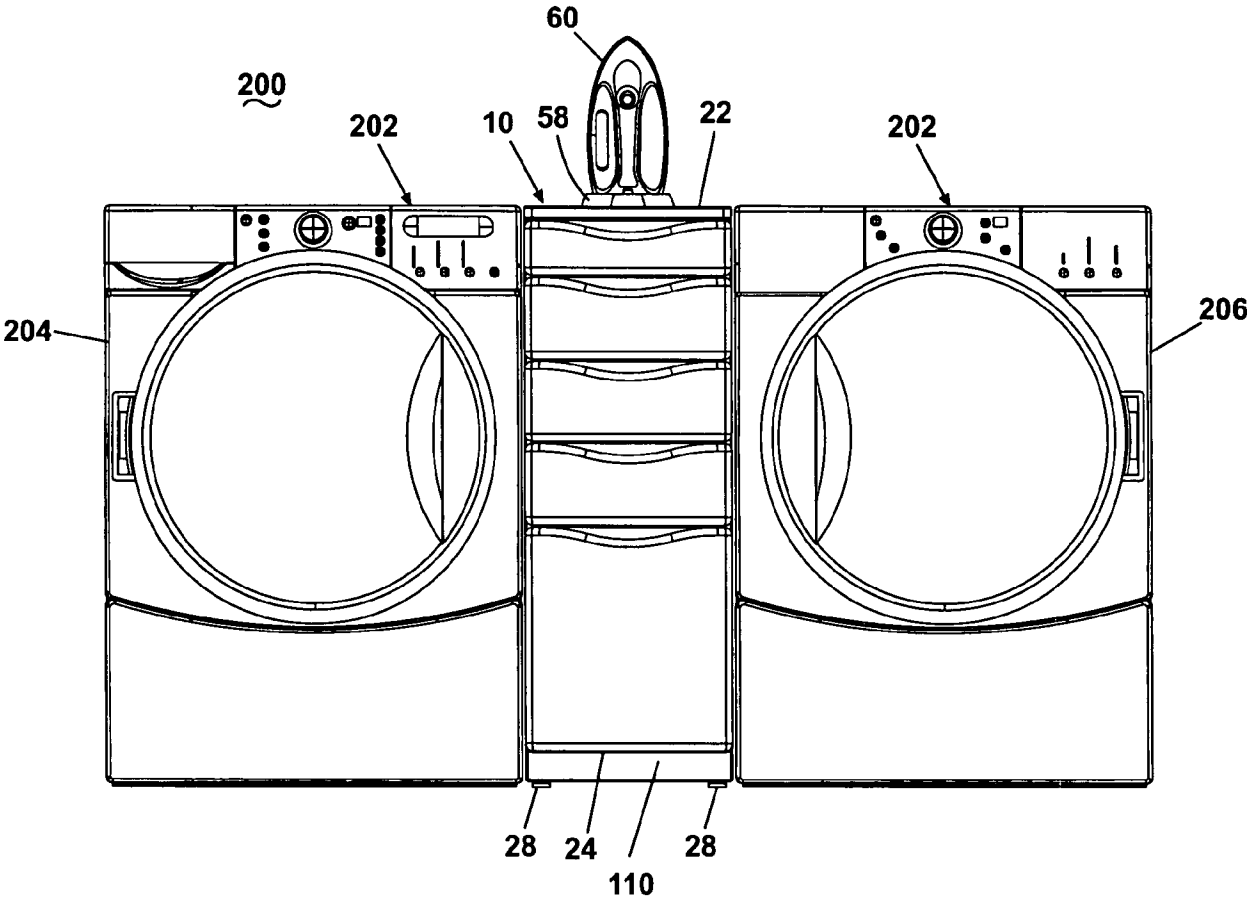
FIG. 11 is a front view of a laundry system comprising the ironing station shown in FIG. 1.

Referring to FIG. 11, an illustrative example of a laundry system 200 is given, where the ironing station 10 is positioned between two laundry appliances 202. The laundry appliances comprise a front-loading washing machine 204 and clothes dryer 206. Additional configurations of laundry systems 200 comprising the ironing station 10 are disclosed in the above-referenced patents.

As shown in FIG. 11, the ironing station 10 can optionally comprise a pedestal 110 that is mounted to the bottom wall 24 of the cabinet 12. The width and depth of the pedestal 110 are approximately equal to the width and depth of the ironing station 10. The height of the pedestal 110 can vary. An exemplary height for the pedestal 110 is about 2.36". The pedestal 110 functions as an adapter so that the user can custom tailor the ironing station 10. For example, the user can add the pedestal 110 to the ironing station 10 to raise the height of the ironing board 30 to a desired height for ironing. In another example, the user can add the pedestal 110 to the ironing station 10 to raise the height of the top wall 22 to a desired height that matches the height of another laundry appliance 200. This is especially useful when the ironing station 10 is positioned directly adjacent a laundry appliance 200, as shown in FIG. 11. The pedestal 110 can be added to any of the embodiments of the ironing station 10 discussed herein.

While the invention has been specifically described in connection with certain specific embodiments thereof, it is to be understood that this is by way of illustration and not of limitation, and the scope of the appended claims should be construed as broadly as the prior art will permit.

What is claimed is:

1. An ironing station comprising:

a cabinet comprising spaced side walls connected by a top wall to at least partially define an interior space accessible through an open face of the cabinet;

a storage area defined within the interior space of the cabinet and comprising multiple drawers slidably mounted to the cabinet for movement through the open face;

an ironing board stowably mounted to the cabinet for selective movement between a stowed position where the ironing board is at least partially stored within the interior space and a use position; and a docking station mounted to the cabinet that receives and provides power to an iron.

2. The ironing station according to claim 1, wherein the docking station supports the iron on the top wall of the cabinet.

3. The ironing station according to claim 2, wherein the docking station is formed in the top wall of the cabinet.

4. The ironing station according to claim 1, wherein the ironing board is slidably mounted to the cabinet.

5. The ironing station according to claim 4 and further comprising a support slidably mounted to the cabinet and carrying the ironing board to slidably mount the ironing board to the cabinet.

6. The ironing station according to claim 5, wherein the ironing board is mounted to the support for movement in at least one of linear and rotational movement.

7. The ironing station according to claim 6, wherein the ironing board is mounted to the support for both linear and rotational movement.

8. The ironing station according to claim 5 and further comprising a front panel pivotally mounted to the support between an up position for hiding the ironing board when the ironing board is in the stowed position and a down position for moving the ironing board relative to the support.

9. The ironing station according to claim 1, wherein the storage area comprises door selectively closing at least a portion of the open face of the cabinet.

10. The ironing station according to claim 9, wherein the storage area further comprises a drawer slidably mounted to the cabinet for movement through the open face.

11. The ironing station according to claim 1, wherein the docking station comprises a power supply to provide power to the iron.

12. The ironing station according to claim 11, wherein the docking station provides power to an iron received in the docking station.

13. The ironing station according to claim 12, wherein the power supply automatically supplies power to the iron when the iron is received by the docking station.

14. The ironing station according to claim 13 and further comprising a cordless iron.

15. An ironing station comprising:

a cabinet comprising spaced side walls connected by a top wall to at least partially define an interior space accessible through an open face of the cabinet;

a storage area defined within the interior space of the cabinet and accessible through the open face;

an ironing board stowably mounted to the cabinet for selective movement between a stowed and a use position;

a support slidably mounted to the cabinet and carrying the ironing board to slidably mount the ironing board to the cabinet;

a front panel pivotally mounted to the support for movement between an up position for hiding the ironing board when the ironing board is in the stowed position and a down position for moving the ironing board relative to the support; and a docking station provided on the top wall of the cabinet that receives and provides power to an iron.

16. The ironing station according to claim 15, wherein the docking station is formed in the top wall of the cabinet.

17. The ironing station according to claim 15, wherein the ironing board is received within the interior space of the cabinet in the stowed position.

18. The ironing station according to claim 15, wherein the ironing board is mounted to the support for movement in at least one of a linear and rotational movement.

19. The ironing station according to claim 18, wherein the ironing board is mounted to the support for both linear and rotational movement.

20. The ironing station according to claim 15, wherein the storage area comprises door selectively closing at least a portion of the open face of the cabinet.

21. The ironing station according to claim 20, wherein the storage area further comprises a drawer slidably mounted to the cabinet for movement through the open face.

22. The ironing station according to claim 15, wherein the docking station comprises a power supply to provide power to the iron.

23. The ironing station according to claim 22, wherein the docking station provides power to an iron received in the docking station.

24. The ironing station according to claim 23, wherein the power supply automatically supplies power to the iron when the iron is received by the docking station.

25. The ironing station according to claim 24, and further comprising a cordless iron.

26. The ironing station according to claim 22, wherein the storage area comprises a drawer slidably mounted to the cabinet for movement through the open face.

27. The ironing station according to claim 26, wherein the storage area comprises multiple drawers slideably mounted to the cabinet for movement through the open face.

28. An ironing station comprising:

a cabinet comprising spaced side walls connected by a top wall to at least partially define an interior space accessible through an open face of the cabinet;

a storage area defined within the interior space of the cabinet and accessible through the open face;

an ironing board stowably mounted to the cabinet for selective movement between a stowed and a use position, wherein the ironing board is formed by a leaf pivotally mounted to the cabinet and at least a portion of the top wall of the cabinet; and a docking station provided on the top wall of the cabinet that receives and provides power to an iron.

29. The ironing station according to claim 28, wherein the leaf overlies the at least a portion of the top wall when the ironing board is in the stowed position.

30. The ironing station according to claim 29, wherein the leaf forms a generally continuous surface with at least a portion of the top wall of the cabinet when in the stowed position.

31. The ironing station according to claim 28 and further comprising a support mounted to the cabinet for supporting the leaf when the ironing board is in the use position.

32. The ironing station according to claim 28, wherein the docking station comprises a power supply to provide power to the iron.

33. The ironing station according to claim 32, wherein the docking station provides power to an iron received in the docking station.

34. The ironing station according to claim 28, wherein the storage area comprises door selectively closing at least a portion of the open face of the cabinet.

35. The ironing station according to claim 34, wherein the storage area further comprises a drawer slidably mounted to the cabinet for movement through the open face.

* * * * *